United States Patent [19]

Mannhart

[11] 4,152,931

[45] May 8, 1979

[54] METHOD AND APPARATUS FOR EVALUATING YARN SIGNALS HAVING AN AT LEAST APPROXIMATELY PERIODIC COMPONENT

[75] Inventor: Werner Mannhart, Uster, Switzerland

[73] Assignee: Zellweger, Ltd., Switzerland

[21] Appl. No.: 878,783

[22] Filed: Feb. 17, 1978

[30] Foreign Application Priority Data

Mar. 21, 1977 [CH] Switzerland ..... 3482/77

[51] Int. Cl.[2] ..... G01D 1/04

[52] U.S. Cl. ..... 73/160; 57/265

[58] Field of Search ..... 73/160; 57/34 R; 240/675; 19/0.23

[56] References Cited

U.S. PATENT DOCUMENTS

| | | | |
|---|---|---|---|
| 4,007,457 | 2/1977 | Aeppli | 73/160 X |
| 4,051,722 | 10/1977 | Feller | 73/160 |

*Primary Examiner*—Jerry W. Myracle

*Attorney, Agent, or Firm*—Craig & Antonelli

[57] ABSTRACT

A method and apparatus for evaluating yarn signals having at least an approximately periodic component superimposed on an irregularity provides for determining the polarity values of successive signal components using a comparator and the evaluation of coincidence of such polarity values during a predetermined period using counting means.

9 Claims, 4 Drawing Figures

METHOD AND APPARATUS FOR EVALUATING YARN SIGNALS HAVING AN AT LEAST APPROXIMATELY PERIODIC COMPONENT

The invention relates to a method of and an apparatus for evaluating yarn signals having an at least approximately periodic component superimposed on an irregularity.

Modern methods of producing yarns make it necessary to monitor the yarn at the spinning positions continuously and directly. Irregularities at individual spinning positions may thus be detected immediately and necessary measures taken so that the production of faulty yarns is recognized at the moment of formation and is prevented as quickly as possible after detection.

The plurality of spinning positions used in operation, however, also requires a plurality of monitoring devices. Accordingly, it is desirable to provide a method of monitoring which requires as low an outlay on devices for carrying out the method as possible.

In order to do this, the number of requirements to be met by such monitoring methods has to be restricted to individual criteria. In order to detect the production of faulty yarns at an early stage, it is absolutely essential to determine periodic components superimposed upon the general irregularity caused by the production process. If such periodic components do not stand out particularly in the general irregularity, they may have a very disturbing effect during further processing of the yarn, for example, by producing a so-called Moiré effect which makes the corresponding fabric unusable.

Various methods and apparatus are already known for determining periodic components in the irregularity of yarn parameters. However, they are either too slow or require an additional expensive circuit.

By restricting the evaluation of the irregularity, or of the yarn signal obtained from the detection of the irregularity, of the yarn by means of measuring instruments known per se merely to the periodic components thereof, it has been found that autocorrelation was initially suitable for this purpose, particularly since it affords a basis for evaluating the yarn signals by means of digital signa-processing methods.

According to the present invention there is provided a method of evaluating yarn signals in which there is at least one approximately periodic portion superimposed on an irregularity, wherein yarn signals are obtained from the cross section or diameter of the yarn by means of detectors, the polarities of discrete values of the yarn signals are determined in comparators, and at least one counting device is used to determine how often a coinciding polarity of the yarn signals is found in constant intervals $\tau$, for all time intervals $\tau$ in a predetermined range $\tau_2-\tau_1$.

The invention also provides an apparatus for evaluating yarn signals having at least one approximately periodic portion superimposed on an irregularity, comprising comparators for determining the polarity of discrete values of the yarn signals, at least one counting device for determining the number of values in constant intervals with coinciding polarity for all intervals in a predetermined range $\tau_2-\tau_1$, and threshold value devices for determining if prescribed numerical values are exceeded in the counting devices.

When processing a yarn signal in an 8-bit microcomputer, the yarn signal is quantized into 256 quantization stages. However, the number of quantization stages may be reduced, if desired, to two quantization stages being obtained in the limiting case. Thus, for example, logic "1" is provided if the signal is positive or logic "" is provided if the signal is negative. In other words, the sign function of the yarn signal is formed which is defined as $$sgn\,[\delta\,(x)] = \begin{cases} 1 \text{ when } (x) \geqq 0 \\ 0 \text{ when } (x) < 0 \end{cases} \tag{1}$$

In this case, the autocorrelation function may be calculated very simply as:

$$R\,(\tau) = \frac{1}{N} \sum_{k=1}^{N} x\,(k\Delta t) \cdot x\,(k\Delta t - \tau) \tag{2}$$

Since the EXOR function enters at the position of multiplication and may be effected in terms of circuitry by a gate or by a 2 μsec command in the case of the microcomputer. This autocorrelation function at the sign function is also known as polarity coincidence detection.

Figure 1:
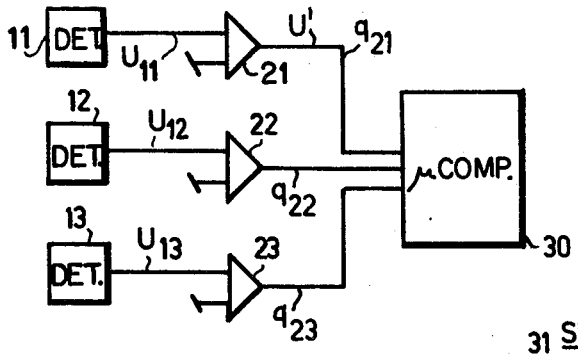
FIG. 1 is a schematic block diagram of a first embodiment of an apparatus according to the invention.

The analog-digital converter is reduced to a comparator. When processing with an n-bit microcomputer, n such quantized signals may be introduced in parallel. Such an arrangement is shown in FIG. 1. Yarn signals $U_{11}$, $U_{12}$, $U_{13}$ received by the detectors 11, 12, 13 are quantized in comparators 21, 22, 23, i.e., are broken down into positive or negative signals $q_{21}$, $q_{22}$, $q_{23}$ each of which is fed to an input of a microcomputer 30 for further evaluation.

Since the signal amplitudes have no effect on the value of the sign function, control of amplification or sensitivity is unnecessary. In addition, the comparators 21, 22, 23 may be integrated into the detectors 11, 12, 13. The detectors then emit only two possible initial states, thus increasing the protection from interference.

However, this method of evaluation only allows periodic cross-sectional variations to be determined, but not those of increased irregularity. Another simplification is produced if the equation $$P = \sum_{\tau=\tau_4}^{\tau_2} R\,(\tau) \tag{3}$$

is calculated, instead of the autocorrelations function R ($\tau$) according to equation 2 of the sign function. This function may be produced by means of a simple circuit without the need of a microcomputer. If the limits $\tau_1$ and $\tau_2$ are selected to be such that they include the range of the possible periods and evaluation continues over a sufficiently long period, this function is also capable of distinguishing yarn signals with a periodic portion from normal yarn. This can be confirmed experimentally.

Figure 2:
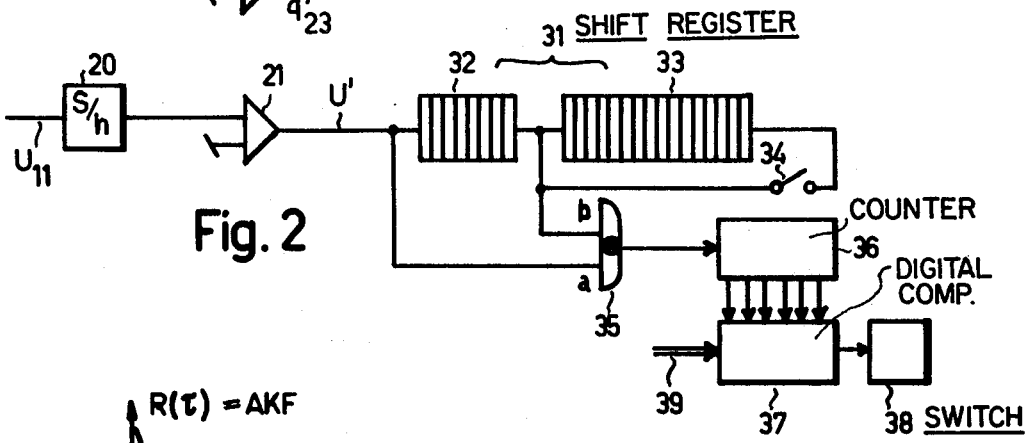
FIG. 2 is a schematic block diagram of a second embodiment of the invention.

A circuit arrangement for producing the function P according to equation 3 for a passage is shown in FIG. 2.

The procedure begins with the clearing of an up/-down counter 36. An amplitude value U' of the yarn signal $U_{11}$ is then scanned by a "Sample-and-hold" stage 20. A comparator 21 produces the sign function. Depending on the polarity of the scanned value, "0" or "1" appears at the out output thereof. This value is read into a serial k-bit shift register 31 and the entire content is shifted to the right by a bit. The value which is in the right-hand position usually overflows in this process. This shift register contains the k most recently scanned of the scanned values U' of the signal $U_{11}$ reduced to the polarity symbol thereof. The switch 34 which is connected in parallel with a part 33 of the shift register 31 is now closed so that the contents of the part 33 of the shift register may be circulated once in shift register 33. In this process, each bit is compared with the new bit at the output of the comparator 21 by means of an EXOR gate 35.

If the two bits are equal, the EXOR gate 35 allows the counter 36 to count one unit upwards, and if not, to count one unit downwards. With a purely stochastic signal, the number of coinciding bits will be equal to the number of non-coinciding bits. The counter 36 thus counts upwards as frequently as downwards. Its final value after a monitoring interval of sufficient duration is thus approximately 0. However, if the yarn signal has a periodic portion, coincidences take place more frequently. The counter 36 then counts upwards more frequently than downwards and contains a value at the end of a cycle which exceeds a prescribed reference value so that a digital comparator 37 acting as a threshold device transmits a pulse to a switching means 38. The switching means 38 controls signaling or adjusting devices which indicate the appearance of yarn signals with periodic portions.

The length of the first part 32 of the shift register 31 determines the avalue of $\tau$, and the length of the entire shift register 31 determines $\tau_2$. This is illustrated in the following example. If the yarn is scanned at 1 cm intervals and if the entire shift register is 24 bits long with the reading after 10 bits, then $\tau_1$ corresponds to a period length of 10 cm and $\tau_2$ to a period length of 24 cm. However, the detectable range is not thus restricted to a period length of from 10 to 24 cm but includes the range from 5 cm to 24 cm. A period of 5 cm does, in fact, have a first harmonic at 10 cm when the autocorrelation function (ACF) is formed and this first harmonic falls in the directly detectable range of from 10 cm to 24 cm.

Figure 3:
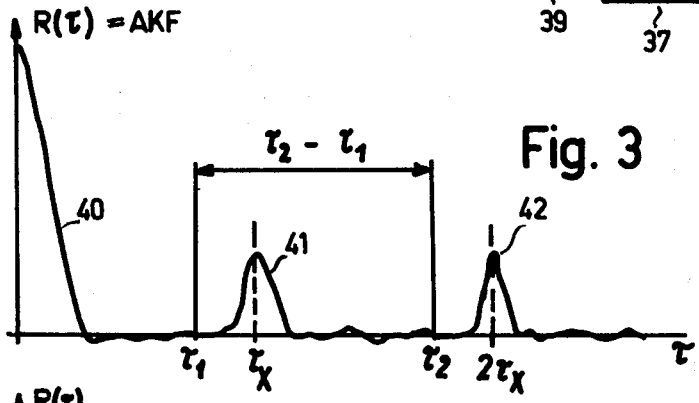
FIG. 3 is a diagram showing an autocorrelation function of the sign function of a first yarn signal.

The line 40 in FIG. 3 shows the ACF R ($\tau$) of the sign function of a yarn signal with a periodic portion wherein the period length has been determined with $\tau_x$ at a peak 41, for example, with 15 cm wavelength. The peak 41 means that a predominantly coinciding polarity is determined at intervals of 15 cm, for example, more frequently than in intervals of 20 cm. This peak is repeated at 42 (2 $\tau_x$, at 3 $\tau_x$ and so forth), which is a fundamental pproperty of the ACF.

The value P according to equation 3 corresponds to the area above the abscissa minus the area below the abscissa. This value is larger if a peak 41 is present as a result of a periodic portion in the yarn signal than when this is not the case.

Since the length of a period which is present in all cases is not known in advance, it is not sufficient to calculate the ACF merely for a particular value of $\tau$. Rather, it is determined for a range $\tau_2-\tau_1$, in which periods are possible or expected.

Figure 4:
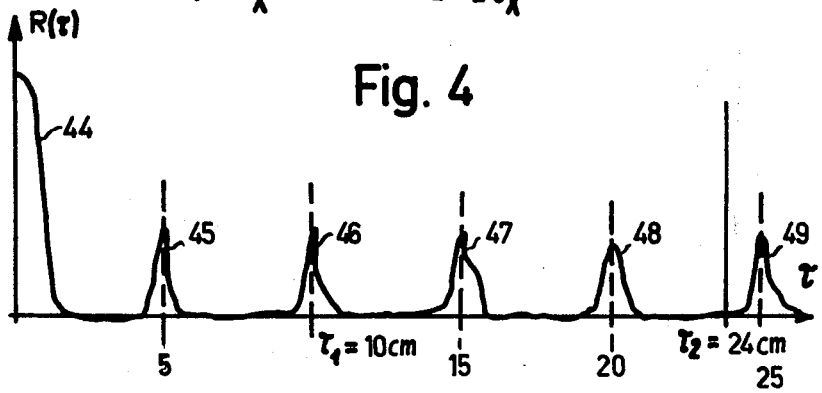
FIG. 4 is a diagram showing another autocorrelation function.

FIG. 4 shows an ACF 44 with a period of 5 cm. The first peak 45 which represents the fundamental wave lies beneath the range $\tau_1=10$ cm to $\tau_2=24$ cm which may be measured in the example according to FIG. 3. The harmonics with peaks 46, 47, 48, however, lie within this range. Periods with shorter wavelengths may thus also be detected with a measurement range $\tau_2$ to $\tau_1$ from 10 to 24 cm.

While I have shown and described several embodiments in accordance with the present invention, it is understood that the same is not limited thereto but is susceptible of numerous changes and modifications as known to those of skill in the art; and, I therefore do not wish to be limited to the details shown and described herein but intend to cover all such changes and modifications as are obvious to those of ordinary skill in the art.

What is claimed is:

1. A method of evaluating yarn signals having at least one approximately periodic portion superimposed on an irregularity, comprising the steps of generating yarn signals representing the cross section or diameter of the yarn by means of detectors, determining the polarities of discrete values of the yarn signals, and detecting how often a coinciding polarity of the yarn signals is found in constant intervals $\tau$, for all time intervals in a predetermined range.

2. A method of evaluating yarn signals according to claim 1 where the yarn signals from a plurality of detectors are processed in a central evaluating device which is provided with the counting device.

3. A method of evaluating yarn signals according to claim 1 wherein said step of detecting is carried out by using at least one counting device.

4. An apparatus for evaluating yarn signals having at least one approximately periodic portion superimposed on an irregularity, comprising comparator means for determining the polarity of discrete signal values of the yarn signals; evaluating means including at least one counting device for determining the number of signal values in constant intervals with coinciding polarity for all intervals in a predetermined range; and threshold value means for determining if prescribed numerical values are exceeded in said counting device.

5. An apparatus according to claim 4 wherein an n-bit microcomputer is used as said counting device.

6. An apparatus according to claim 5 wherein each bit of the n-bit microcomputer forms a passage for the evaluation of n-quantized signals introduced in parallel.

7. An apparatus according to claim 4 wherein said evaluating means comprises a divided shift register; a switch connected in parallel with one part of the divided shift register, so that when the switch is closed the contents of said one part may be circulated; a gate to which the output signals of said comparator means are fed via a first input and to which the values circulating in one part of said divided shift register are fed via a second input, the gate acting to compare the polarity values contained in the divided shift register with a new polarity value passing from the comparator means in such a way that when these values coincide a unit is added to said counting device and when they do not coincide one unit is substracted from said counting device.

8. An apparatus according to claim 7 wherein said evaluating means further comprises second comparator means which assigns to the counting device a predetermined maximum value and switching means for indicating periodic portions in the yarn signal when the predetermined maximum value is exceeded in said counting device.

9. An apparatus according to claim 8 wherein the yarn signals of a plurality of detectors are fed to said evaluating means containing said counting device, said divided shift register, said gate and said second comparator means.

* * * * *